United States Patent [19]

Drennen et al.

[11] 4,190,491

[45] Feb. 26, 1980

[54] PROCESS FOR CONTROLLING PITCH IN PAPERMAKING

[75] Inventors: Thomas J. Drennen, Lafayette Hills; Robert A. Gill, Abington, both of Pa.

[73] Assignee: Rohm and Haas Company, Philadelphia, Pa.

[21] Appl. No.: 936,537

[22] Filed: Aug. 24, 1978

Related U.S. Application Data

[63] Continuation of Ser. No. 710,823, Aug. 2, 1976, abandoned.

[51] Int. Cl.[2] ..... D21C 9/08

[52] U.S. Cl. ..... 162/76; 162/72; 162/DIG. 4

[58] Field of Search ..... 162/72, 76, 168 N, 68 NA, 162/74, 75, DIG. 4; 526/292, 312; 260/78.3 UA, 79.3 M; 208/39, 44; 252/352, 356, 357, 383, 384

[56] References Cited

U.S. PATENT DOCUMENTS

| | | | |
|---|---|---|---|
| 2,838,397 | 6/1958 | Gruntfest et al. | 162/168 N X |
| 3,081,219 | 3/1963 | Drennen et al. | 162/72 |
| 3,617,372 | 11/1971 | McNamee et al. | 526/312 X |
| 3,804,668 | 4/1974 | Bakule et al. | 526/312 X |

*Primary Examiner*—Arthur L. Corbin

[57] ABSTRACT

A process for preventing deposition of pitch in papermaking comprising incorporating in a paper pulp slurry a water-soluble linear cationic polymer comprised of units of the formula

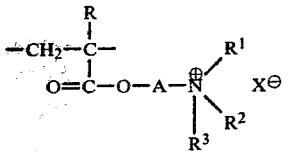

wherein

A is a ($C_2$-$C_3$) alkylene group,
R is H or $CH_3$;
$R^1$ is a hydroxyethyl or hydroxypropyl group,
$R^2$ is a ($C_1$-$C_4$) alkyl group,
$R^3$ is a ($C_1$-$C_4$) alkyl group, and
X is an anion;

said polymer having a viscosity average molecular weight of about 35,000 to 70,000.

6 Claims, No Drawings

PROCESS FOR CONTROLLING PITCH IN PAPERMAKING

This is a continuation, of application Ser. No. 710,823 filed Aug. 2, 1976, now abandoned.

BACKGROUND OF THE INVENTION

1. Field of the Invention

This invention relates to control of pitch in papermaking, and of the compositions useful therefor.

2. Description of the Prior Art

The most efficient prior pitch control agents are sodium salts, especially sodium salts of sulfonated naphthalene-formaldehyde condensate. The aforementioned pitch control agents are anionic which causes them to suffer from the disadvantage that when they are used in a system which contains cationic additives such as cationic wet strength resins, cationic sizing agents, cationic retention aids, cationic drainage aids, cationic dry strength resins, and the like, the anionic pitch control agents react and precipitate the cationic additives. Presently, when the paper system contains a cationic additive, either no pitch control agent is used, or one tries to emulsify the pitch with surfactant, or one uses clay to detackify pitch. Clay is cheap, but one must use large amounts of it to control pitch, often over 1% by weight based on pulp solids; furthermore, and more importantly, clay is a debonding agent and so can weaken the paper sheet, and also the pitch is non-dispersed and so can cause spots in the paper. A non-ionic pitch dispersant is disclosed in Drennen et al, U.S. Pat. No. 3,081,219, but a disadvantage of non-ionic dispersants is that they do not function to retain the pitch in the pulp.

Pitch has become more of a problem in recent years due to the growing tendency of mills to use high yield pulps which are less pure than previously. The pulps are not cooked as long or washed as thoroughly as in previous years, so the paper now contains increased levels of pitch and other anionic pulpwood resins and rosin.

Another cause of increased pitch and other associated sticking problems is closed white water systems which have come into being because of ecological necessity. Another cause of increased pitch problems is the trend to cut logs into chips in the forest rather than at the mill, and so the chips are prepared while the log is still green, causing exuding. Another cause of increased pitch problems is the inclusion of lower grade woods and fresher timber.

A need has arisen for a more efficient pitch control agent which is compatible with cationic wet end additives.

It is an object of the present invention to provide a pitch control agent which is compatible with cationic wet end additives.

A further object is to provide a pitch control additive which functions to disperse pitch and to deposit or retain the dispersed pitch into the pulp in finely divided form.

Another object is to provide a pitch control method which is efficient and does not interfere with the function of other additives.

These objects, and others as will become apparent from the following disclosure, are achieved by the process of the present invention which comprises the utilization of a composition for preventing deposition of pitch comprising a water soluble, linear cationic polymer comprised of units of the formula

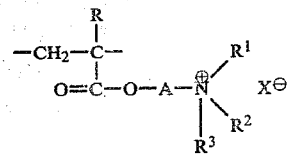

wherein A is a ($C_2$–$C_3$) alkylene group,

R is H or $CH_3$;

$R^1$ is hydroxyethyl or hydroxypropyl group, $R^2$ is a ($C_1$–$C_4$) alkyl group, $R^3$ is a ($C_1$–$C_4$) alkyl group, and X is an anion;

said polymer having a viscosity average molecular weight, $\overline{M}_v$, of about 35,000 to 70,000.

In another aspect the invention comprises a process for controlling pitch in papermaking comprising incorporating about 0.01 to 0.5% by weight of said composition in the pulp slurry, said ratio being based on pulp solids.

DETAILED DESCRIPTION OF THE INVENTION AND PREFERRED EMBODIMENTS

The pitch control additive of the invention can be introduced into the pulp at any stage of the pulping operation, including introduction prior to, or after digestion, during beating, in the stock-chest, or even in the headbox of the papermaking machine.

It is preferred to add the pitch control additive early in the pulping or papermaking stage before the pitch is coagulated by the mechanical work performed on the pulp during the papermaking operations.

The proportion of pitch control agent suitably employed is about 0.01 to 0.5% by weight, preferably 0.02 to 0.2% by weight, and most preferably 0.02 to 0.1% by weight, based on pulp solids.

The molecular weight of the polymers of the invention has been found to be suprisingly important with regard to their function as pitch control agents. Viscosity average molecular weights of about 35,000 to 70,000, are suitable; and about 40,000 to 60,000 are preferred.

The preparation of these pitch control additive polymers is taught in U.S. Pat. Nos. 3,617,372 and 3,804,668, except for the molecular weights. The molecular weights defined above are achieved by control of the amount of initiator used in the polymerization. A preferred initiator system is ammonium persulfate combined with sodium metabisulfite, in preferred amounts of about 1.0 to 1.8% by weight of each, based on monomer charge.

When the polymer $\overline{M}_v$ is above about 70,000, it has been discovered that dispersing action is reduced, and agglomeration occurs. When the $\overline{M}_v$ is below about 35,000, it has been discovered the retention of the dispersed pitch in the pulp is too low. Surprisingly, when the $\overline{M}_v$ is within the above range, both dispersing and retention action occurs.

The polymers can also contain units derived from one or more other ethylenically unsaturated monomers, such as vinyl esters of ($C_1$–$C_{18}$) aliphatic acids, such as vinyl acetate, laurate, and stearate; esters of acrylic acid or methacrylic acid with ($C_1$–$C_{18}$) alcohols, including ($C_1$–$C_{18}$) alkanols, benzyl alcohol, cyclohexyl alcohol, and isobornyl alcohol, such as methyl acrylate or methacrylate, ethyl acrylate or methacrylate, butyl acrylate or methacrylate, or 2-ethylhexyl acrylate or methacrylate, octadecyl acrylate or methacrylate; vinyl aromatic hydrocarbons (e.g., styrene, isopropenyl toluene, and various dialkyl styrenes); acrylonitrile, methacrylonitrile, ethacrylonitrile, and phenylacrylonitrile; acrylamide, methacrylamide, ethacrylamide, N-methylol acrylamide, N-monoalkyl and -dialkyl acrylamides and methacrylamides, e.g., N-monomethyl, -ethyl, -propyl, -butyl, and N-dimethyl, -ethyl, -propyl, -butyl, etc., alkacrylamides, e.g., N-monophenyl- and -diphenyl -acrylamides and -methacrylamides; vinyl ethers, such as butyl vinyl ether; N-vinyl lactams such as N-vinyl pyrrolidone; and olefins, such as ethylene, fluorinated vinyl compounds, such as vinylidene fluoride; β-hydroxyethyl acrylate or methacrylate or any of the hydroxyl-containing or amine-containing monomers mentioned in columns 2 and 3 of U.S. Pat. No. 3,150,112; vinyl chloride and vinylidene chloride; alkyl vinyl ketones; e.g., methyl vinyl ketone, ethyl vinyl ketone, and methyl isopropenyl ketone; itaconic diesters, e.g., the dimethyl, diethyl, dipropyl, dibutyl and other saturated aliphatic monohydric alcohol diesters of itaconic acid, diphenyl itaconate, dibenzyl itaconate, di-(phenylethyl) itaconate; allyl and methallyl esters of saturated aliphatic monocarboxylic acid, e.g., allyl and methallyl acetates, allyl and methallyl propionates, allyl and methallyl valerates; vinyl thiophene; 4-vinyl pyridine; and vinyl pyrrole. In the monomer system from which the polymers of the invention are polymerized, from 0 to about 50% by weight can be one or more of the above-mentioned other ethylenically unsaturated monomers.

The preferred other ethylenically unsaturated monomers are methyl methacrylate, methyl acrylate, ethyl acrylate, isobutyl acrylate, secondary butyl acrylate, butyl acrylate, hydroxyethyl methacrylate, vinyl acetate, styrene, and a rylonitrile.

The polymers are either partially or fully quaternized with a quaternizing agent. Preferably the polymers are at least 50% quaternized; more preferably at least about 80% quaternized, and most preferably about 100% quaternized.

Preferred quaternization agents are alkylene oxides and active halides, particularly the alkylene oxides. Examples of alkylene oxides are ethylene oxide, propylene oxide, butylene oxide, styrene oxide, and epichlorohydrin. Examples of active halides are methyl halides such as methyl chloride, bromide and iodide; benzyl halides such as benzyl chloride, etc.; and allyl halides such as allyl chloride, etc.

The anion in the polymers of the invention, represented in the formula as X, is preferably an anion such as acetate, formate, lactate, citrate, propionate, glycolate, sulfate, oxalate, nitrate, or halide.

The following examples are presented to illustrate a few embodiments of the invention, but the invention is not limited thereto. Parts and percentages are by weight unless otherwise indicated.

EXAMPLE 1

This example illustrates the preparation of a homopolymer of N,N-dimethyl-N-(β-hydroxyethyl)-N-(β-methacryloxyethyl)ammonium acetate having a molecular weight (viscosity average) of 46,000 as determined by formula from an intrinsic viscosity measured as 0.101.

1925 parts glacial acetic acid, 6049 parts deionized water and 285.6 parts of 0.15% aqueous $FeSO_4.H_2O$ are charged to a pressure kettle. The kettle charge is deoxygenated with $N_2$, heated to 60° C., and the following materials are charged over a 3 hour period: 4781 parts dimethylaminoethyl methacrylate, 97.51 parts ammonium persulfate in 1162.49 parts deionized water, and 97.51 parts sodium metabisulfite in 1162.49 parts deionized water. The temperature is held at 60° C. for another 30 minutes, then lowered to 40° C. at which temperature 1406.9 parts ethylene oxide is gradually added. The resultant product is a clear amber liquid having a Brookfield viscosity of 370–430 cps., and a pH of 6.5–7.0.

EXAMPLE 2

The procedure of Example 1 is repeated except replacing the 1925 parts glacial acetic acid with a respective one of the following:

A. 2890 parts lactic acid
B. 2440 parts glycolic acid
C. 1478 parts formic acid
D. 2361 parts propionic acid
E. 1168 parts hydrochloric acid
F. 2019 parts nitric acid
G. 2885 parts oxalic acid
H. 1571 parts sulfuric acid
I. 6156 parts citric acid

EXAMPLE 3

Following the procedure of Example 1, a copolymer of methyl acrylate with N,N-dimethyl-N-(β-hydroxypropyl)-N-(β-methacryloxyethyl)ammonium acetate, quaternized with epichlorohydrin, having an $\overline{M}_v$ of 60,000, is prepared. The weight ratio of methyl acrylate units to N,N-dimethyl-N-(β-hydroxypropyl)-N-(β-methacryloxyethyl)ammonium acetate units is 0.25.

EXAMPLES 4A–4G

The procedures of Example 3 is repeated except the following respective amounts of the following ethylenically unsaturated monomers are substituted for the methyl acrylate.

A. 30% methyl methacrylate
B. 25% acrylonitrile
C. 50% ethyl acrylate
D. 20% styrene
E. 25% hydroxyethyl acrylate
F. 20% secondary butyl acrylate
G. 30% butyl acrylate

EXAMPLE 5 (Comparative)

The procedure of Example 1 is repeated except, by increasing the amount of ammonium persulfate and sodium metabisulfite catalyst to 2.00% each, the molecular weight of the polymer is reduced to 29,000 (intrinsic viscosity=0.068).

EXAMPLE 6 (Comparative)

The procedure of Example 1 is repeated except, by decreasing the amount of ammonium persulfate and sodium metabisulfite catalyst to 0.68% each, the polymer molecular weight is increased 72,000 (intrinsic viscosity=0.150).

EXAMPLE 7 (Comparative)

The procedure of Example 1 is repeated except by increasing the amount of ammonium persulfate and sodium metabisulfite catalyst to 2.72% each, the molecular weight is decreased to 22,000 (intrinsic viscosity=0.053).

EXAMPLE 8

This example shows the effect of the pitch control agents of the invention, and the improved performance of the pitch control agents of the invention versus certain closely related materials which are outside the invention. In this experiment bleached sulfite pulp in the dry form or state (unbeaten, 650CSF) is treated with synthetic pitch (0.5 ml. Mobil 600 W per 45 grams pulp at 15° C.). The oil contains fatty resin acids which simulate natural pitch.

TAPPI test method RC-324 is used to determine the amount of pitch deposited in the pulps.

The paper produced in the experiments is examined under ultraviolet light to determine the appearance of the pitch in the paper.

The results shown in Table I demonstrate the importance of molecular weight of the pitch control additive polymer in order to achieve both pitch reduction, dispersion into very fine particles, and retention in the pulp.

TABLE 1

| Additive of Example No. | % Additive by Weight Based on Pulp Solids | Deposited Pitch | % Pitch Reduction | Appearance of Treated Paper (U.V.) |
|---|---|---|---|---|
| None | — | 37 mgs. | — | — |
| 6 | 0.25% | 6.8 | 81 | Large agglomerates of Pitch in sheet |
| 6 | 0.10% | 9.2 | 75 | Large agglomerates of Pitch in sheet |
| 1 | 0.25% | 6.3 | 83 | Very fine particles-Good retention |
| 1 | 0.10% | 7.9 | 79 | Very fine particles-Good retention |
| 5 | 0.25% | 8.6 | 77 | Very fine particles-Poor retention |
| 7 | 0.25% | 11.3 | 69 | Very fine particles-Poor retention |

We claim:

1. A process for controlling pitch in papermaking comprising the step of incorporating in a pitch-containing paper pulp slurry about 0.01 to 0.05% by weight based on pulp solids of a water-soluble, linear cationic polymer comprised of units of the formula:

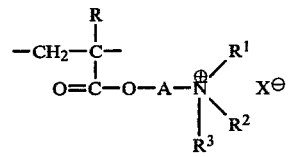

wherein

A is a ($C_2$–$C_3$) alkylene group,
R is H or $CH_3$;
$R^1$ is a hydroxyethyl or hydroxypropyl group,
$R^2$ is a ($C_1$–$C_4$) alkyl group,
$R^3$ is a ($C_1$–$C_4$) alkyl group, and
X is an anion;

said polymer having a viscosity average molecular weight of about 35,000 to 70,000.

2. The process of claim 1 wherein the polymer has a viscosity average molecular weight of about 40,000 to 60,000.

3. The process of claim 1 wherein said polymer is also comprised of units derived from one or more other ethylenically unsaturated monomers.

4. The process of claim 1 in which the anion is selected from the group consisting of acetate, nitrate, formate, lactate, citrate, propionate, glycolate, sulfate, oxalate and halide.

5. The process of claim 4 in which the anion is acetate, nitrate, sulfate or halide.

6. The process of claim 4 in which a cationic additive, in addition to the water soluble linear cationic polymer of the given formula, is added to the paper pulp slurry.

* * * * *